US007455199B2

(12) United States Patent
Cockings et al.

(10) Patent No.: US 7,455,199 B2
(45) Date of Patent: Nov. 25, 2008

(54) FROZEN AERATED PRODUCT IN A CONTAINER AND A VALVE FOR DISPENSING SUCH

(75) Inventors: Terence Richard Lawrence Cockings, Bedfordshire (GB); Robert Theodoor Feenstra, Rome (IT); Robert Daniel Keenan, Bedfordshire (GB); Richard Henry Luck, Bedfordshire (GB)

(73) Assignee: Good Humor - Breyers Ice Cream, division of Conopco, Inc., Green Bay, WI (US)

( * ) Notice: Subject to any disclaimer, the term of this patent is extended or adjusted under 35 U.S.C. 154(b) by 610 days.

(21) Appl. No.: 11/070,966

(22) Filed: Mar. 2, 2005

(65) Prior Publication Data

US 2005/0193744 A1 Sep. 8, 2005

(30) Foreign Application Priority Data

Mar. 3, 2004 (GB) ..... 0404715.5

(51) Int. Cl.
*B65D 83/00* (2006.01)

(52) U.S. Cl. ..... 222/402.1; 222/94; 222/389

(58) Field of Classification Search ..... 222/402.1, 222/402.13, 402.15, 386.5, 389, 94, 386, 222/334

See application file for complete search history.

(56) References Cited

U.S. PATENT DOCUMENTS 3,344,964 A 10/1967 Diamond
3,677,443 A * 7/1972 Smadar et al. ..... 222/94
3,901,410 A * 8/1975 Schultz ..... 222/153.14
5,032,619 A * 7/1991 Frutin et al. ..... 521/55
5,150,820 A * 9/1992 McGill ..... 222/95
5,419,466 A * 5/1995 Scheindel ..... 222/389
5,441,181 A * 8/1995 Scheindel ..... 222/389
5,505,336 A 4/1996 Montgomery et al.
5,690,256 A * 11/1997 Smith ..... 222/402.1
6,325,256 B1 * 12/2001 Liljeqvist et al. ..... 222/402.15
6,340,103 B1 1/2002 Scheindel et al.
6,588,628 B2 * 7/2003 Abplanalp et al. ..... 222/105
6,880,732 B2 * 4/2005 Scheindel ..... 222/387

(Continued)

FOREIGN PATENT DOCUMENTS

DE 23 47 546 3/1975

(Continued)

OTHER PUBLICATIONS

International Search Report on Application No. PCT/EP2005/002160 dated Jun. 2, 2005.

(Continued)

*Primary Examiner*—Frederick C. Nicolas
(74) *Attorney, Agent, or Firm*—Michael P. Aronson

(57) ABSTRACT

A frozen aerated product in a container is provided. The product is under a pressure of between 4 and 18 barg, and the container is provided with a valve. The valve has a flow rate of above 6 g $s^{-1}$, preferably between 10 and 30 g $s^{-1}$. The flow rate of the valve being the mass flow rate at which the frozen aerated product, having a temperature of −18° C., is discharged through the fully open valve to atmospheric pressure. Also provided are valves suitable for dispensing viscous products at high flow rate while retaining a low opening and actuation force.

22 Claims, 14 Drawing Sheets

U.S. PATENT DOCUMENTS

2004/0001905 A1 1/2004 Campbell et al.

FOREIGN PATENT DOCUMENTS

| | | |
|---|---|---|
| EP | 004 546 | 11/1981 |
| GB | 2 011 548 | 7/1979 |
| WO | 03/096821 | 11/2003 |
| WO | 2004/043826 | 5/2004 |

OTHER PUBLICATIONS

Written Opinion of the International Searching Authority.
Great Britian Search Report on Application No. GB0404715.5 dated Aug. 9, 2004 and Jan. 14, 2005.

* cited by examiner

Fig. 4a
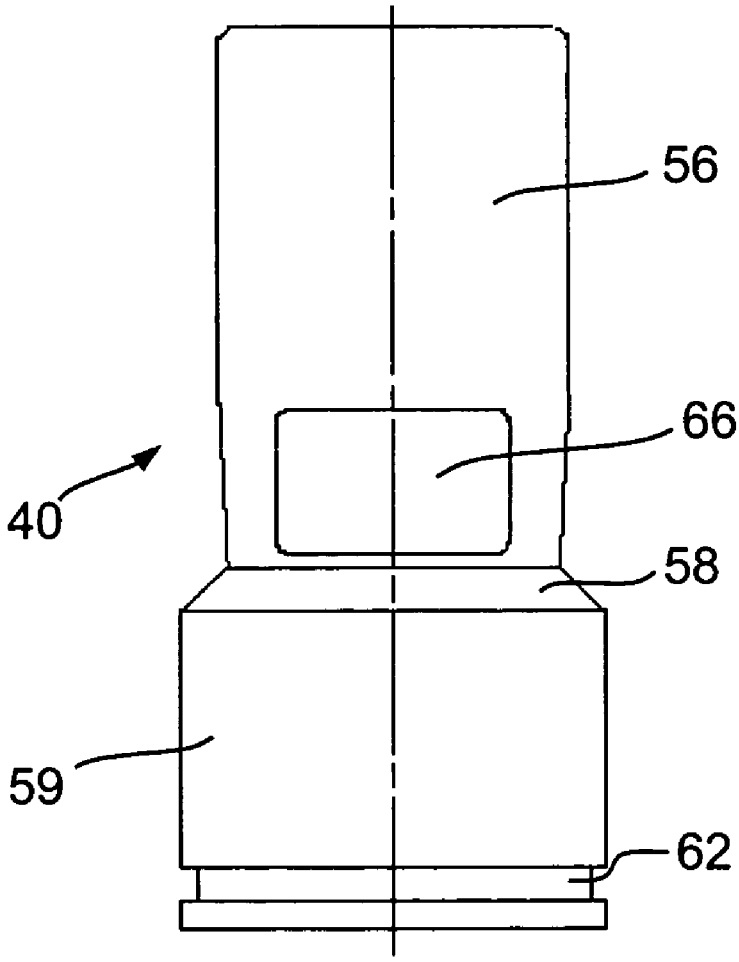
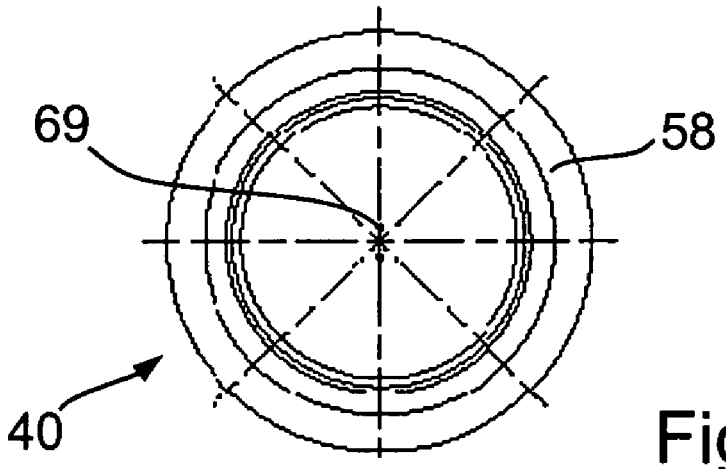
Fig. 4b

FROZEN AERATED PRODUCT IN A CONTAINER AND A VALVE FOR DISPENSING SUCH

FIELD OF THE INVENTION

The present invention relates to a frozen aerated product in a container and valves for dispensing such. The present invention more particularly relates to products commonly referred to as aerosols.

BACKGROUND OF THE INVENTION

The availability of aerosol creams and toppings has led to their widespread use in customising desserts and beverages. Ice cream and similar frozen aerated products are often used as alternatives to whipped creams and toppings. The lack of such a product in an aerosol form, however, has meant that it is not possible to apply frozen products in such a controlled and convenient manner as whipped creams and thus limits their versatility. In addition, there has long been a need to provide soft-serve ice cream, a popular out-of-home dessert, in a form where it may be dispensed at home directly on removal from the freezer.

Aerosol systems for dispensing frozen aerated products have been proposed in the past. WO 03/096821 discloses such a system wherein the frozen aerated product is provided in a container, the container having at least two compartments and the frozen aerated product containing freezing point depressants in an amount between 20% and 40% w/w and having a number average molecular weight $<M>_n$ dependant on the fat level in the frozen aerated product. The container may be provided with a valve having an N value (ratio of the flow rate of a Newtonian fluid and the viscosity to the pressure drop across the valve) of between 5×10^(−11) $m^3$ and 1×10^(−7) $m^3$. Furthermore, embodiments are described with flow rates up to 4.7 g $s^{-1}$ at −18° C.

Such technology allows for a frozen aerated product that may be dispensed from an aerosol can at the temperature of a domestic freezer (−18 to −22° C.) and represents a significant improvement over prior technologies. We have found, however, that there exists a need for further improvements in aerosol systems for dispensing frozen aerated products. In particular, the rate at which product is dispensed with the existing technology requires the user to hold the valve open for a considerable length of time. In addition, if conventional aerosol valves are used then the actuation force is found to be undesirably high for one-fingered actuation. Thus the products may not be applied to all of the applications for which aerosol whipped creams and toppings are used.

There is thus a need for an improved aerosol system for dispensing aerated products in a convenient manner at a temperature of a domestic freezer.

It has been found that it is possible to achieve such a goal by providing a frozen aerated product in a container equipped with a valve with a flow rate in a specific range. Furthermore, by careful design of the valve it has been found possible to provide valves suitable for dispensing viscous products from aerosol cans at high rates but which have low opening and actuating forces.

Tests and Definitions

Pressure

In the description 'barg' means 'bar gauge' (i.e., relative to 1 atm) and the pressure was measured at a temperature of −10° C.

Flow Rate

The flow rate of a valve arranged to dispense a frozen aerated product from a container is defined as the mass flow rate at which the frozen aerated product, having a temperature of −18° C., is discharged through the fully open valve to atmospheric pressure.

The flow rate is determined as follows.

Four specimens of a frozen aerated product in a container equipped with a valve and actuator are tempered at −18° C. for 24 hours. The actuator is designed to avoid any restriction of the flow of product following exiting from the valve such that any measurement of flow rate is a true measurement of flow through the valve alone. Each specimen is then taken from the −18° C. store, around 10 g of product dispensed through the valve and actuator and then the specimen returned to the −18° C. store. This pre-test dispensing ensures that the valve and actuator are charged fully with product while the small volume dispensed ensures that the pressure in the container is reduced only by a negligible amount. The cans are stored for a further 24 hours at −18° C. prior to testing.

For testing, a can is removed from the −18° C. store and the valve immediately actuated for a total of 10 s. This actuation is such that the valve is open to its full extent. The product dispensed during this actuation is collected and weighed. The flow rate for a specimen is then calculated by dividing the mass collected by 10 s. The process is then repeated for the other three specimens. The flow rate of the valve is taken to be the mean of the flow rate of the four specimens and the uncertainties quoted are the corresponding 95% confidence intervals.

Definition of Constriction

A constriction is defined as channel or orifice through which a product dispensed through a valve must pass. The cross-sectional area of such a constriction is the area of the channel or orifice, in a plane normal to the direction of flow of the product through the constriction during dispensing.

Opening Force

The opening force of a valve arranged to dispense a frozen aerated product from a container is defined as the minimum force that can be applied directly to the valve in order to open the valve to its full extent at a rate of 100 mm $min^{-1}$, wherein the frozen aerated product has a temperature of −22° C.

The opening force is determined as follows.

Four specimens of a frozen aerated product in a container equipped with a valve (but not an actuator) are tested. The specimens are tempered at −22° C. for 24 hours prior to testing.

For testing, a can is removed from the −22° C. store and immediately secured in a cradle located in the environmental chamber of an Instron™ Universal Testing Machine. The cradle is designed to ensure that the container is static during testing and that the valve is located such that lowering or raising of the cross-head of the Instron™ opens the valve. The environmental chamber is supplied with liquid nitrogen and held at a constant temperature of −22° C. The cross-head is designed to allow full actuation without restricting the flow of product out of the valve. The cross-head is moved until it is around 0.5 mm away from touching the valve stem (or other valve member arranged to open the valve on application of a force) and the force meter on the testing machine is zeroed. The cross-head is then moved at a rate of 100 mm $min^{-1}$ until the valve is opened to its full extent, the force applied being recorded every 0.1 $s^{-1}$. The opening force for the specimen is taken to be the maximum force applied during the test. The process is then repeated for the other three specimens. The opening force of the valve is taken to be the mean of the opening force of the four specimens and the uncertainties quoted are the corresponding 95% confidence intervals.

Actuation Force

The actuation force of an actuating member provided to a valve arranged to dispense a frozen aerated product from a container is defined as the minimum force that can be applied directly to the actuating member in order to open the valve to its full extent when the member is moved at a rate of 100 mm $min^{-1}$, wherein the frozen aerated product has a temperature of −22° C.

The actuation force is determined in an identical manner to that described for determining the opening force with two exceptions. Firstly, the valves are equipped with actuators. Secondly, the cross-head used is a simple cylinder and rather than acting directly on the valve stem (or other valve member arranged to open the valve on application of a force), the cross-head is moved onto the actuator during the test in order to mimic the action of the finger of a user when dispensing the product.

Average Molecular Weight

The average molecular weight for a mixture of freezing point depressants (fdps) is defined by the number average molecular weight $<M>_n$ (equation 1). Where $w_i$ is the mass of species i, $M_i$ is the molar mass of species i and $N_i$ is the number of moles of species i of molar mass $M_i$.

$$<M>_n = \frac{\sum w_i}{\sum (w_i / M_i)} = \frac{\sum N_i M_i}{\sum N_i} \qquad \text{Equation 1}$$

Freezing Point Depressants

Freezing point depressants (fpds) as defined in this invention consist in:

Monosaccharides and disaccharides.

Oligosaccharides containing from 3 to ten monosaccharide units joined in glycosidic linkage.

Corn syrups with a dextrose equivalent (DE) of greater than 20 preferably >40 and more preferably >60. Corn syrups are complex multi-component sugar mixtures and the dextrose equivalent is a common industrial means of classification. Since they are complex mixtures their number average molecular weight <M>n can be calculated from the equation below. (Journal of Food Engineering, 33 (1997) 221-226).

$$DE = \frac{18016}{<M>_n}$$

Erythritol, arabitol, glycerol, xylitol, sorbitol, mannitol, lactitol and malitol.

Definition of Overrun

Overrun is defined by the following equation $$OR = \frac{\text{volume of frozen aerated product} - \text{volume of premix at ambient temp}}{\text{volume of premix at ambient temp}} \times 100$$

It is measured at atmospheric pressure.

Definition of R Value

For a valve arranged to dispense a pressurised product, which is opened by the application of an opening force to one or other of a valve stem and a first member, a parameter R is defined by the following equation:

$$R = A_m / A_b.$$

Wherein $A_b$ is the maximum area of a cross-section of the stem bore in a plane normal to the direction of flow of the product during dispensing and $A_m$ is the area of an orthographic projection on to a plane normal to the direction of the opening force of those solid portions, on which with the valve in a closed position the pressure of the product acts in a direction opposite to the direction of the opening force, of the one or other of the valve stem and the first member to which the opening force is applied.

SUMMARY OF THE INVENTION

It is a first object of the present invention to provide a frozen aerated product in a container, the product being under a pressure of between 4 and 18 barg, the container being provided with a valve; characterised in that the valve has a flow rate of above 6 g $s^{-1}$, preferably between 10 and 30 g $s^{-1}$. Such a system is found to be particularly convenient to use directly from a domestic deep freeze, especially in applications normally reserved for aerosol whipped creams and toppings, such as the customisation of beverages and desserts. It also provides a versatile way of delivering individual portions of soft-serve ice cream at home directly on removal from the freezer.

Preferably the valve comprises a constriction having a cross-sectional area of less than 200 $mm^2$, preferably less than 150 $mm^2$. Preferably also the cross-sectional area is greater than 30 $mm^2$. A valve having such a constriction is advantageous as, if the flow of a product through a valve is unconstrained then for a given mass flow rate of product, the linear velocity at which the product is dispensed will be lower than that desirable for applications such as customisation of desserts and beverages.

Preferably the valve has an opening force of less than 300 N, more preferably between 20 and 200 N. Preferably also, the valve is provided with an actuating member having an actuation force of less than 50 N, preferably between 20 to 35 N. We have determined that the use of valves and actuating members which have low opening and actuation forces respectively, allows for more versatile dispensing of frozen aerated products by affording the ability of the user to actuate the valve with a single hand or even a single finger.

In a preferred embodiment the container has at least two compartments (A) and (B), the compartments being gastightly separated from each other by an at least partially movable wall, compartment (A) containing a propellant, compartment (B) containing the frozen aerated product and compartment (B) being provided with the valve. Such a two-compartment system ensures that the product is always adjacent to the valve. This is desirable as the extremely viscous nature of frozen aerated products means that inversion of the container does not overcome the yield stress of the product and the product does not flow to the valve. Also dip tubes are to be avoided as the requirement for the product to flow through a long, narrow tube severely reduces the flow rate of the product.

In another preferred embodiment the frozen aerated product contains freezing point depressants in an amount between 20% and 40% w/w, preferably above 25%, and between 0% and 15% fat, preferably between 2% and 12%, the freezing point depressants having a number average molecular weight $<M>_n$ following the following condition:

$$<M>_n=<(330-8*FAT)\ g\ mol^{-1}$$

wherein FAT is the fat level in percent by weight of the product. Frozen aerated products with such a composition are found to be soft and extrudable even at the temperature of a domestic deep freezer.

In a particularly preferred embodiment the valve comprises: a valve stem having one or more apertures therein, the valve stem having a product outlet, a bore extending from the product outlet to the apertures, and a longitudinal axis; a first member having one or more apertures therein; and a resiliently biasable second member; one or other of the valve stem and the first member being slidably and coaxially mountable on or in the other of the valve stem and the first member; the valve stem and the first member being arranged such that on application of an opening force on one or other of the valve stem and the first member, the valve stem and the first member slide relative to each other in a direction parallel to the longitudinal axis of the stem and one or more of the apertures in the first member are brought into fluid communication with one or more of the apertures in the valve stem, the second member being arranged to force the apertures in the first member and the valve stem out of fluid communication when the opening force is released; characterised in that the ratio R is less than 2.0, preferably less than 1.1, more preferably R is less than 0.1. Preferably also, the second member comprises one or more springs.

A survey of known aerosol valves has shown that the ratio R is always much greater than 2. For example, for the valves described in FIG. 4 of U.S. Pat. No. 3,780,913, R is around 11.6; in the valves described in FIG. 1 of U.S. Pat. No. 6,149,077, R is around 10.6. Even in valves designed to allow for high discharge rates, such as the EM8 valve from Coster Aerosol Ltd (Stevenage, UK) which is similar in design to the valve shown in FIG. 1*a* of the present application, R is no less than around 3.7. We have found that using such designs with a value of $A_b$ sufficiently large to dispense a frozen aerated product results in a high value of $A_m$ and hence a large opening force thereby rendering the system undesirable in use. When R is less than 2.0 a valve can be provided with a sufficiently high flow rate and an acceptable opening force. Valves wherein R is less than 0.1, more preferably less than 0.05, and optimally less than 0.01 are found to be particularly advantageous as the opening force is then substantially, if not completely, independent of the pressure and rheology of a product that the valve is arranged to dispense.

In another preferred embodiment, the apertures in both the first member and the valve stem which are brought into fluid communication upon application of an opening force are located within the body of the container whilst in fluid communication. The advantage of requiring the apertures to be in fluid communication within the body of the container is that in the event of damage to the externally protruding parts of the valve either in use or in transit, the frozen aerated product should be retained within the container.

In a preferred embodiment, in the absence of the applied opening force, the second member is substantially free from contact with the frozen aerated product in the container. Preferably also, in the presence of the applied opening force, the second member is substantially free from contact with the frozen aerated product in the container. We have determined that in some instances, interaction of a frozen product with the second member can affect the ease with which a valve may be opened, especially when the product has a high viscosity such that it affects the ability of the second member to bias.

In another preferred embodiment the second member is located entirely within the body of the container. Location of the second member in such a way ensures that its performance is not hindered in the event of damage to the externally protruding parts of the valve either in use or in transit.

In yet another preferred embodiment, the valve is provided with an actuating member comprising: a first portion and a second portion, the second portion being hingedly attached to the first portion, the second portion being arranged to apply force to the one or other of the valve stem and the first member on application of a force thereto by a user. Preferably the second portion of the actuating member has a first end and a second end, the first end being attachable to a hinge on the first portion of the actuating member, and the second end being free, wherein the ratio of the distance from the hinge of the actuating member to the free end of the second portion is approximately three to eight times, preferably five to seven times, the distance from the hinge to a central longitudinal axis of the valve stem.

Such an actuating member is particularly advantageous owing to the multiplication of the actuation force resulting from the use of a lever allowing for valves to be used wherein the valve has a high opening force without inconveniencing the user by requiring a high actuation force. The length of the lever should be limited, however, to prevent the actuating member becoming too large and therefore impractical to use and store, especially in applications where the container is held in one hand and the valve actuated with the same hand.

It is a second object of the present invention to provide a valve comprising: a valve stem having one or more apertures therein, the valve stem having a product outlet, a bore extending from the product outlet to the apertures and a longitudinal axis; a first member having one or more apertures therein; and a resiliently biasable second member; one or other of the valve stem and the first member being slidably and coaxially mountable on or in the other of the valve stem and the first member; the valve stem and the first member being arranged such that on application of an opening force on one or other of the valve stem and the first member, the valve stem and the first member slide relative to each other in a direction parallel to the longitudinal axis of the valve stem and one or more of the apertures in the first member are brought into fluid communication with one or more of the apertures in the valve stem, the second member being arranged to force the apertures in the first member and the valve stem out of fluid communication when the opening force is released; characterised in that the ratio R is less than 2.0, preferably less than 1.1. Preferably also the second member comprises one or more springs.

Preferably, with the valve in a closed position, the one or other of the valve stem and the first member to which the opening force is applied is isolated from any pressure higher than atmospheric pressure acting in a direction opposite to that of the opening force, such that R is less than 0.1, more preferably less than 0.05 and optimally less than 0.01.

Because the valve stem and the first member slide relative to each other in a direction parallel to the longitudinal axis the valve provides for efficient filling through the valve, as the direction of flow of a product is then parallel with the movement of the valve during opening.

Preferably the stem has a base portion and the stem bore extends longitudinally through the base portion of the stem. The advantage of having a valve stem with the bore extending through the base portion is that the area of the base portion is minimised such that in situations where the opening force is applied to the stem and where the base portion is in contact with the internal pressure of the container, the area $A_m$ is kept to a minimum.

A further object of the present invention is to provide a valve for dispensing a product from a pressurised container, the valve comprising: a first piece which is fixedly attachable to the container; a second piece which is coaxially translatable on or in the first piece; a valve seat disposed between the first and second pieces and defining a closure, the valve seat being within the body of the container; and a bore extending from the seat to a product outlet; the valve being openable by coaxial translation of the second piece on or in the first piece in an opening direction; characterised in that the total surface area ($A_m$) of the second piece on which the internal pressure of the container acts in a direction opposite to the opening direction is less than 30% of the cross-sectional area of the bore ($A_b$).

Because the valve is openable by coaxial translation, the valve provides for more efficient filling through the valve than rotatable valves, as the direction of flow of a product may be parallel with the movement of the valve during opening.

Preferably, the total surface area ($A_m$) of the second piece on which the internal pressure of the container acts in a direction opposite to the opening direction is less than 10%, more preferably less than 5% and optimally less than 1% of the cross-sectional area of the bore ($A_b$) as the opening force is then substantially, if not completely, independent of the internal pressure of the container and/or the rheology of the product that the valve is arranged to dispense.

Furthermore, location of the valve seat within the container ensures that in the event of damage to the externally protruding parts of the valve, either in use or in transit, the product should be retained within the container In a preferred embodiment the valve additionally comprises a resiliently biasable member (e.g. one or more springs) arranged to apply a closing force to the second piece. This arrangement allows for automatic closure of the valve, i.e. without the need for a user to translate the second piece back to a closed position following actuation. Furthermore, it is preferable that the resiliently biasable member is within the body of the container in order that its performance is not hindered in the event of damage to the externally protruding parts of the valve either in use or in transit.

Preferably also, the bore comprises one or more inlet orifices and extends from the inlet orifices to the product outlet. In a particularly preferred embodiment the inlet orifices of the bore are arranged such that the direction of product flow into the bore during dispensing is substantially perpendicular to the opening direction. By "substantially perpendicular" is meant that the direction of product flow is within 20°, preferably within 10° and more preferably within 5° of perpendicular. Such an arrangement allows for the design of the valve seat (and so the area $A_m$) to be varied substantially, if not completely, independently of the flow rate of product into the bore.

It is also preferred that the bore is located within the second piece.

The valve is particularly suitable for dispensing the frozen aerated product in a container as described herein.

BRIEF DESCRIPTION OF THE DRAWINGS

The present invention will now be described by way of example with reference to the accompanying drawings in which:

FIG. 4*a* is an elevation of a valve stem for use in a valve embodying the present invention;

FIG. 4*b* is a plan view of the stem of FIG. 4*a;*

DETAILED DESCRIPTION OF THE INVENTION

The present invention will be further described with reference to the following preferred embodiments and examples.

Figure 1A:
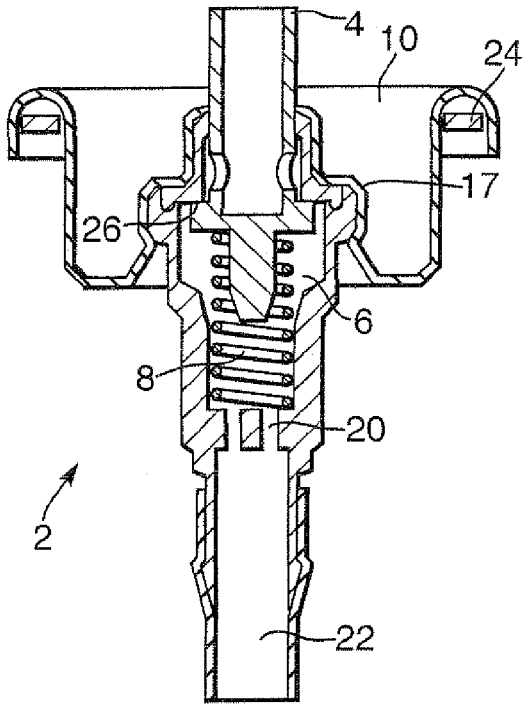
FIG. 1*a* is a sectioned view of a conventional aerosol valve.
Figure 1B:
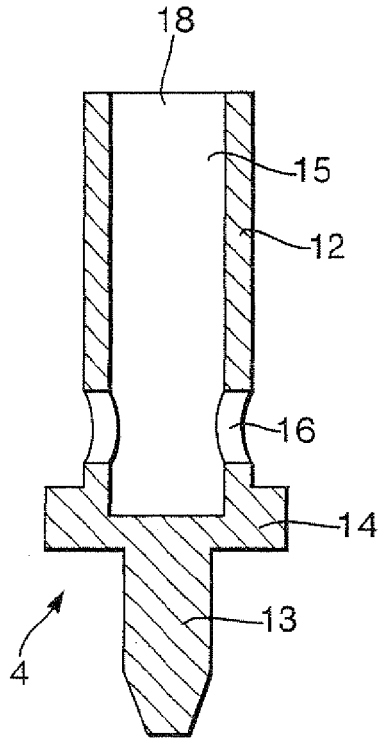
FIG. 1*b* is a sectioned elevation of the valve stem of FIG. 1*a;*

FIG. 1*a* shows a conventional aerosol valve (2) having a valve stem (4) slidably and coaxially mounted in a valve housing (6) and fitted with a spring (8) to act on the stem (4). The housing (6) is mounted in a valve cup (10) which, in use, is attachable to an aerosol can (not shown). FIG. 1*b* shows that the stem (4) consists of a tubular section (12) closed at one end by a circular end portion (14). A plurality of slits or apertures (16) are located in the wall of the tubular section (12) above the end portion (14). A bore (15) extends longitudinally from the product outlet (18) to the apertures (16). Below the end portion (14) there extends longitudinally a finger (13) which is arranged to locate the spring (8). The housing (6) has a stepped internal bore (19) extending longitudinally therethrough, the diameter of the bore at one end being greater than the diameter of the bore at the other end. A plurality of slits or apertures (20) are located in the base of the housing (6) such that the base portion (14) and finger (13) of the stem are constantly in contact with any pressurised product in the can to which the valve is attached. A stem gasket (17) is located in the internal bore (19) of the housing (6) between the top of the end portion (14) of the stem (4) and the valve cup (10).

When mounted in the valve housing (6), the spring (8) forces the end portion (14) of the stem (4) against the base of the stem gasket, which forms a valve seat (26), (17) so that the slits or apertures (16) in the wall of the tubular section (12) of the stem (4) are covered by the stem gasket (17) and any product and/or propellant in the can to which the valve is attached is prevented from escaping.

On application of an opening force the stem (4) is depressed to compress the spring (8) against its natural bias, the slits or apertures (16) in the stem move into the wider diameter section of the bore (19) extending through the housing so that the slits or apertures (16) are uncovered and product may travel up through the housing bore (19) and through the holes and apertures (16) in the stem and through the bore (15) and outlet (18) therein.

The housing (6) may be formed with a dip tube (22) to extend from the valve stem to the bottom of the can to which the valve is attached to allow for dispensing of the product without needing to invert the can.

The valve cup (10) is sealed onto a can in use with a gasket (24) positioned between the outer surface of the valve cup and outer surface of the rim of the bore into which the valve cup is located, to prevent product and propellant from leaking.

In addition to the pressure in the can and the viscosity of the product to be dispensed, the dimensions of the stem (4), such as the length of the stem (4), the diameter of the bore (15) of the stem (4), and the size of the holes or slits (16) determine the rate of flow of the product through the valve in the situation where the housing contains large slits or apertures such that product flow through the housing is not unduly restricted. The larger the area ($A_b$) of the cross-section of the bore (15) in a plane normal to the direction of flow, the greater the flow rate through the stem (4). The longer the bore (15), the lesser the flow rate. Therefore it is common practice in aerosol valves designed to allow for the dispensing of viscous products to maximise the cross-sectional area $A_b$.

In conventional aerosol valves such as that shown in FIG. 1*a* there is a relationship between the cross-sectional area $A_b$ of the bore (15) and the force required to open the valve. In the system of FIG. 1, the magnitude of the opening force required to depress the stem (4) such that the apertures (16) are uncovered is determined not only by the force required to compress the spring (8) but also by the force owing to the pressure of the product inside the can acting on the valve stem (4).

Figure 1C:
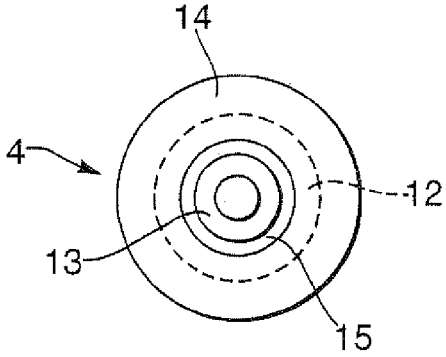
FIG. 1*c* is an orthographic projection on to a plane normal to the direction of the opening force of the valve stem of FIGS. 1*a* and 1*b;*

The contribution of the pressure of the product to the magnitude of the opening force is proportional to the area of an orthographic projection $A_m$ on to a plane normal to the direction of the opening force, of those solid portions of the stem (4) on which, with the valve in a closed position, the pressure inside of the can acts in a direction opposite to the direction of the opening force. FIG. 1*c* shows an orthographic projection of the valve stem (4) in FIGS. 1*a* and 1*b* on to a plane normal to the direction of the opening force. The area $A_m$ in this case is that of the end portion (14) and the finger (13) which is equivalent to the cross-sectional area of the circular end portion (14) alone. Owing to the function of the end portion (14) in forming a seal with the stem gasket (17) in conventional valves such as that shown in FIG. 1, it is necessary that the cross-sectional area of the circular end portion (14) and hence the area $A_m$, be much greater than the cross-sectional area $A_b$ of the bore (15). Thus in conventional valves, the ratio R ($=A_m/A_b$) is always greater than two and the opening force increases as the diameter of the bore (18) is increased.

Figure 2:
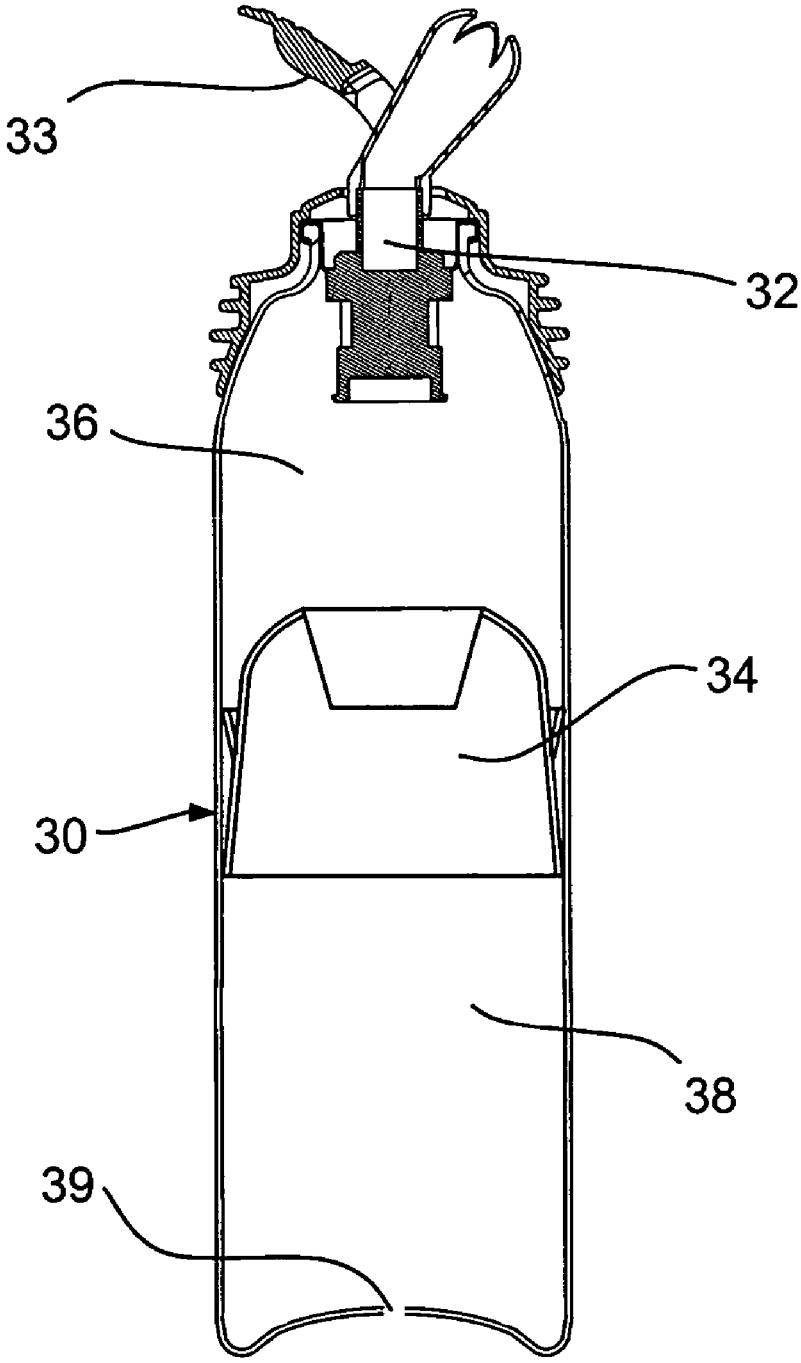
FIG. 2 is a schematic sectioned view of an aerosol can for use in an embodiment of the invention.

FIG. 2 shows a type of compartmentalised can suitable for dispensing a frozen aerated product in accordance with an embodiment of the invention. The can (30) is fitted with a valve (32) to be described below and an actuating member (33). A piston (34) separates the can into two compartments, the upper compartment (36) containing the product to be dispensed in use and the lower compartment (38) containing compressed air, nitrogen or another form of gaseous or liquefied propellant.

In manufacture, the propellant would be forced into the lower compartment (38) through a hole (39) in the base of the can (30) sealed by a rubber plug (not shown) and the product to be dispensed, would be forced through the valve (32) into the upper compartment (36) of the can (30).

FIGS. 3 to 7 show a valve in accordance with a preferred embodiment of the invention comprising a stem section (40), a housing (42), a base section (44), a resilient member (46), for example one or more springs, a first seal (48), a valve cup (50), a cup gasket (52), a second seal (54) and a third seal (49).

The stem section (40) has a first substantially straight tubular section (56) which is connected to a second conical section (58). The second conical section (58) increases in diameter to a third section (59) which is substantially cylindrical and has a substantially constant diameter. The first section (56) has a product outlet (64) and a base portion (68). A plurality of apertures (66) are located in the first section (56). A longitudinally extending bore (65) extends from the product outlet (64) to the apertures (66). The third section (59) contains a groove (62) for receiving the second seal (54), which is preferably formed of rubber having a low glass transition temperature such that it is deformable at temperatures of a domestic deep freeze. The glass transition temperature of the rubber is preferably below −40° C., more preferably below −50° C.

The housing (42) comprises a first portion (70) and second portion (72). The first and second portions are comprised of a plurality of coaxial annular sections of varying outer diameters, the inner diameters being substantially constant. The first and second portions (70), (72) are spaced from each other axially and are coaxially aligned. The first and second portions (70), (72) are joined by a plurality of supporting columns (74), for example four columns. The columns (74) are essentially equally spaced in a circular configuration such that apertures or slits (75) are formed between the columns (74). The external surface of the first portion (70) contains a number of grooves (76) for receiving the first seal (48), which is preferably formed of rubber having a low glass transition. The external surface of the second portion (72) is essentially cylindrical at the base of the columns (74) and then increases in diameter in a stepped manner, terminating in a conical section (79) having a diameter which decreases to the base of the housing (80).

The first rubber seal (48) fits over the outside of the first portion (70) to provide a running seal to the tubular section (56) of the stem section (40). The outside of the seal (48) is shaped to seal with the valve cup (50) in which the valve system (32) is retained in use. The second rubber seal (54) provides a seal between the third section of the stem (59) and the second portion of the housing (72).

The base section (44) comprises two cylindrical sections (82), (84), the first cylindrical section (82) forming a disc. Extending around the outer periphery of the first cylindrical section (82) and projecting upwardly from the upper face thereof, is a short tubular section (83). The second section (84) of the base section (44) is coaxially aligned with the first section (82), the second section (84) having a diameter greater than the first section (82). The second section (84) joins the tubular section (83) just below the top edge of the tubular section (83) in such a manner as to form an annular cavity (91). The annular cavity (91) is shaped to receive the third rubber seal (49) which is preferably formed from a rubber with a low glass transition. The second section (84) has a number of equally spaced cut-out sections (86), for example four cut-out sections. Radially outwardly projecting retaining clips (90) extend from the upper peripheral rim of each of the plurality of cut-out sections (86). The tubular section (83) has an axial bore (92) extending therethrough, the bore being closed at one end by the upper surface of the first section (82). A short cylinder section (88) is located centrally on the upper surface of the first section (82).

The resilient member (46), which comprises for example one or more helical springs, is located in the bore (92) of the base section (44) and projects therethrough. The stem section (40) of the valve system (32) is positioned such that it sits coaxially over the base section (44) with the resilient member (46) projecting into the lower end of the stem section (40). The short cylinder section (88) is arranged to locate the one free end of the resilient member (46) centrally within the bore (92) of the tubular section (83). The other end of the resilient member (46) contacts a plurality of fingers (95) extending downwards from the second conical section (58) and/or the base portion (68) of the stem section (40).

The housing (42) sits over the first section (56) of the stem section (40) so that the stem section (40) projects through the bore in the first portion (70) of the housing (42), and the second portion (72) of the housing (42) fits into the annular cavity (91) of the base section (44) so that the conical section (79) formed at the base of the housing (42) clips under the retaining clips (90) of the base section (44). The third rubber seal (49) forms a seal between the base of the housing (80) and the base section (44). The lower portion of the stem section (40) slides inside the second portion of the housing (72) with the second rubber seal (54) forming a running seal between the stem (40) and the second portion of the housing (72). The second conical section (58) of the stem section (40) is pushed against the inner surface of the first seal (48) on the housing (42) by the resilient member (46).

Figure 7:
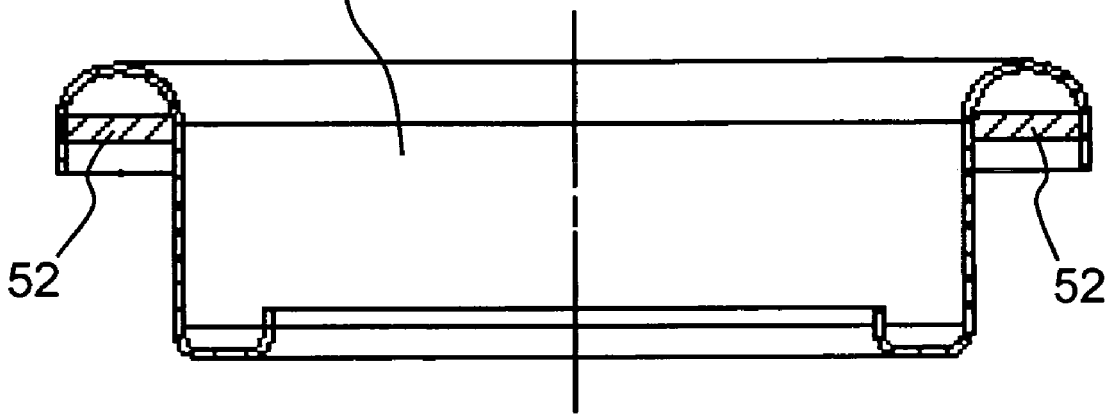
FIG. 7 is a sectioned elevation of a valve cup for use in an embodiment of the invention.
Figure 8A:
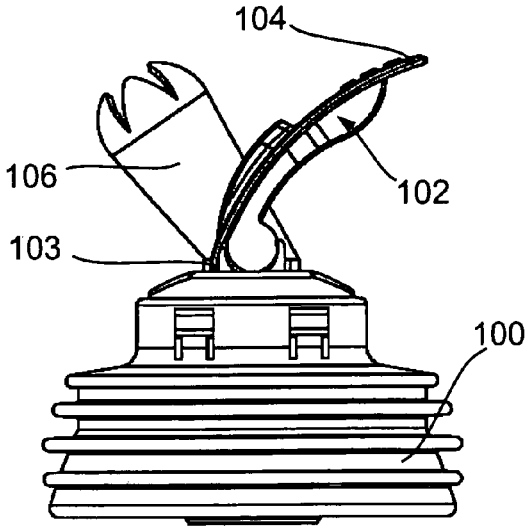
FIGS. 8*a* and 8*b* are elevations of an actuator for use in accordance with an embodiment of the invention.
Figure 8B:
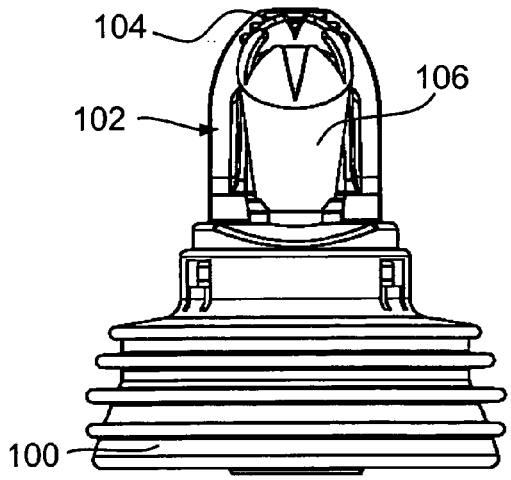
Figure 8C:
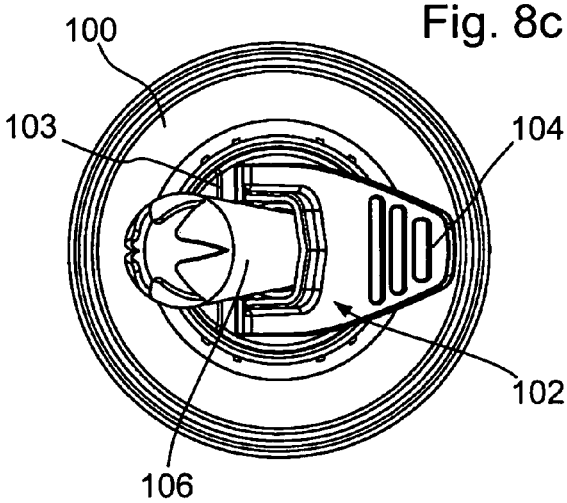
FIG. 8*c* is a plan view of the actuator of FIGS. 8*a* and 8*b;*
Figure 8D:
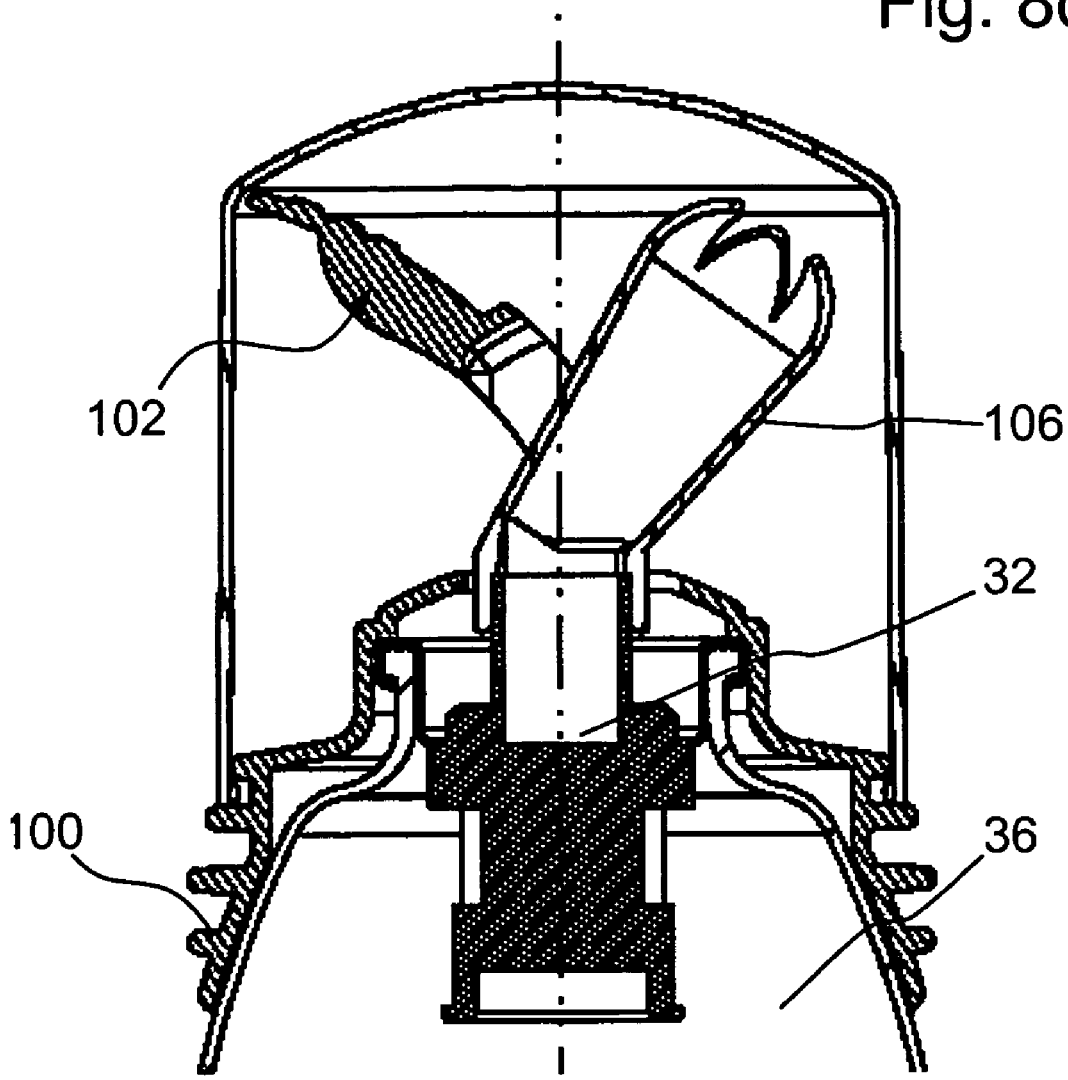
FIG. 8*d* is a sectioned view of the actuator of FIGS. 8*a*-8*c;*

As shown in FIG. 7, the valve cup (50) is similar in design to the standard cup (10) used in conventional aerosol systems and described and illustrated in FIG. 1, the only difference being that the diameter of the aperture into which the valve apparatus is located is larger in the valve cup for use with embodiments of the present invention than the diameter of the corresponding aperture in conventional devices.

In operation, in the closed position, the apertures (66) in the stem (40) are sealed from the product compartment (36) of the container to which the valve assembly (32) is attached by means of the first seal (48), which forms a valve seat (48*a*). Applying an opening force to the stem (40) slides the stem longitudinally downwards towards the base section (44), causing compression of the resilient member (46) against its natural bias, and moving the second conical section (58) of the stem (40) away from the first seal (48) establishing a fluid communication through the apertures (66) in the stem (40) and the apertures (75) between the columns (74) in the housing (42) allowing the product in the can to pass through the apertures, into the bore (65) in the stem (40) and out of the stem outlet (64).

It will be appreciated that, with the valve in the closed position, the stem section (40) is isolated from the pressure in the can acting in a direction opposite to that of the opening force. Thus the R value for the valve shown in FIGS. 2 to 7 is zero.

Owing to the positioning of the second seal (54) and third seal (49) the resilient member (46) is isolated from the product and pressure in the container with the valve in a closed position. In addition, the base portion (68) of the stem section ensures that the resilient member (46) is substantially free from contact with the product at all times. It is, however, desirable that the base portion (68) contains one or more pin holes (69) to avoid problems associated with compression of air under the base portion (68) during opening of the valve. It has been found that two pinholes (69) that are around 0.2 mm in diameter are sufficient to eliminate problems associated with compression of air while being sufficiently small to keep the resilient member (46) substantially free from product in the presence of an applied opening force, i.e., during filling and use.

Figure 3A:
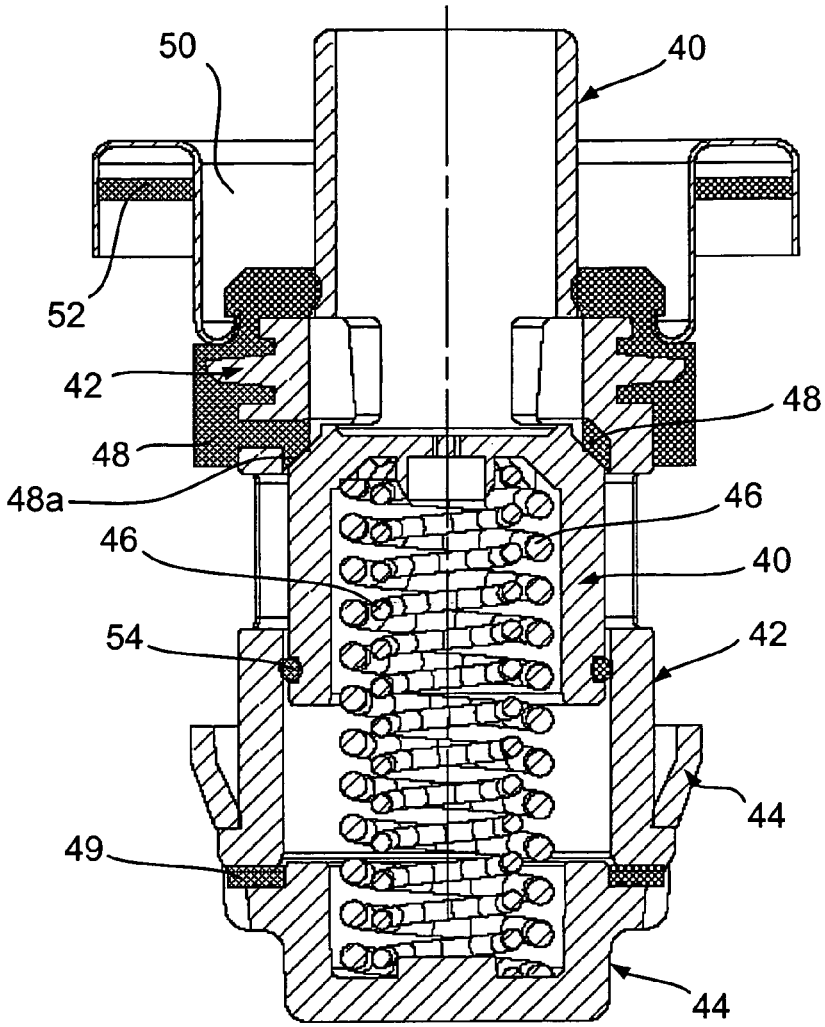
FIG. 3*a* is a sectioned view of a valve in the closed position in accordance with an embodiment of the invention.

When the valve is open, pressurised product is in contact with the upper surfaces of the base portion (68) and the conical section (58) of the stem (40) and thus exerts a downward force on the stem (40). This can cause undesirable resistance to closure of the valve and so it is desirable to use a resilient member with a spring constant greater than that of resilient members used in conventional valves. Such a higher spring constant may be achieved, for example, by the use of two helical springs acting in parallel as shown in FIG. 3*a*.

In use, when attached to the aerosol can, an actuator is fitted over the valve assembly (32), as shown in FIG. 8. The actuator assembly comprises a first section (100) shaped to fit the top of the can, the first section (100) having a central aperture. The actuator assembly further comprises a second section (102) hingedly mounted about a hinge (103) over the central aperture in the first section (100), the second section (102) having an actuating lever (104) projecting radially from the hinge (103). The first and second sections (100), (102) and the hinge (103) may be integrally formed in a single unit.

A nozzle (106) extends through the central aperture of the first section (100) and has a bore which is in fluid communication with the product outlet (64) of the stem (40) of the valve assembly (32). When the actuator is fitted over the valve of FIGS. 3-7, the lower face of the second section (102) of the actuator assembly rests on top of flange in the nozzle (106). Application of an actuation force to the actuating lever (104) causes the second section (102) of the actuator assembly to move about its hinge (103) towards the first section (100) of the actuator assembly. The nozzle (106) and valve stem (40) are thereby forced downwards, opening the valve and allowing product to pass through the stem section (40) and out through the nozzle (106). When the actuating lever (104) is released, the resilient member (46) forces the stem (40) upwards to close the valve and returns the actuator and valve to their closed position.

In a preferred embodiment, the ratio of the distance from the hinge (103) to the edge of the lever (104) is approximately three to eight times the distance from the hinge (103) to the centre of the valve stem (40), such that the actuation force is one-third to one-eighth the opening force of the valve.

FIG. 9*a* through FIG. 9*d* show a further embodiment of a valve according to the present invention comprising a stem section (240), a housing (242), a base section (244), a resilient member (246), for example a spring, a first seal (248), a valve cup (250), a cup gasket (252) and a second seal (254).

The stem section (240) has a first substantially straight tubular section (256) which is connected to a second conical section (258). The second conical section (258) increases in diameter to a third section (259) which is substantially cylindrical and has a substantially constant diameter. Attached to the third section (259) is a substantially conical fourth section (262) whose diameter decreases such that the conical section tapers to the base portion (267) of the stem section (240). A longitudinally extending bore (265) extends from a product outlet (264) through the four sections (256), (258), (259), (262) and the end portion (267) of the stem section (240). A plurality of apertures (266) are located in the first tubular section (256).

The housing (242) comprises a first portion (270) and second portion (272). The first and second portions (270), (272) are joined by a plurality of supporting columns (274), for example four columns, extending between the two portions (270), (272). The columns (274) are essentially equally spaced in a circular configuration such that apertures or slits (275) are formed between the columns (274).

The first rubber seal (248) fits over the outside of the first portion (270) to provide a running seal to the tubular section (256) of the stem section (240). The outside of the seal (248) is shaped to seal with the valve cup (250) in which the valve system is retained in use.

A plurality of fingers (294) are located in a bore (292) of a central post in the base portion (244) and are arranged to retain the one free end of the resilient member (246). The cylindrical second seal (254) extends around the outer periphery of the central post on the base portion (244). The resilient member (246), which may be for example a helical spring, is located in the bore (292) of the base section (244) and projects therethrough. The stem section (240) is positioned such that it sits over the base section (244) with the resilient member (246) projecting into the lower end of the stem section (240). The lower portion of the stem section (240) slides over the seal (254) on the base section (244) such that the seal (254) and the central post of the base section (244) are located within the bore (265) of the stem section (240). The other end of the resilient member (246) contacts a plurality of fingers (295) extending into the bore (265) of the stem section (240) from the second conical section (258) and/or the third cylindrical section (259), towards the base of the stem section (240).

The housing (242) sits over the first section (256) of the stem section (240) so that the stem section (240) projects through the bore in the first portion (270) of the housing (242), and the second portion (272) of the housing (242) fits into the base section (244) so that the base of the housing (280) clips under the retaining clips (290) of the base section (244). The second conical section (258) of the stem section (240) is pushed against the inner surface of the seal (248) on the housing (242) by the resilient member (246).

In operation, in the closed position, the apertures (266) in the first tubular section (256) of the stem (240) are sealed from the pressurised product which the valve is arranged to dispense by means of the seal (248), which forms a valve seat (248*a*). Depressing the stem (240) towards the base section (244), causes compression of the resilient member (246) against its natural bias, and moves the second conical section (258) of the stem (240) away from the seal (248) establishing a fluid communication through the apertures (266) in the stem (240) and the apertures (275) between the columns (274) in the housing (242) allowing the product in the can to pass through the apertures, into the bore (265) in the stem (240) and out of the stem outlet (264).

Figure 9A:
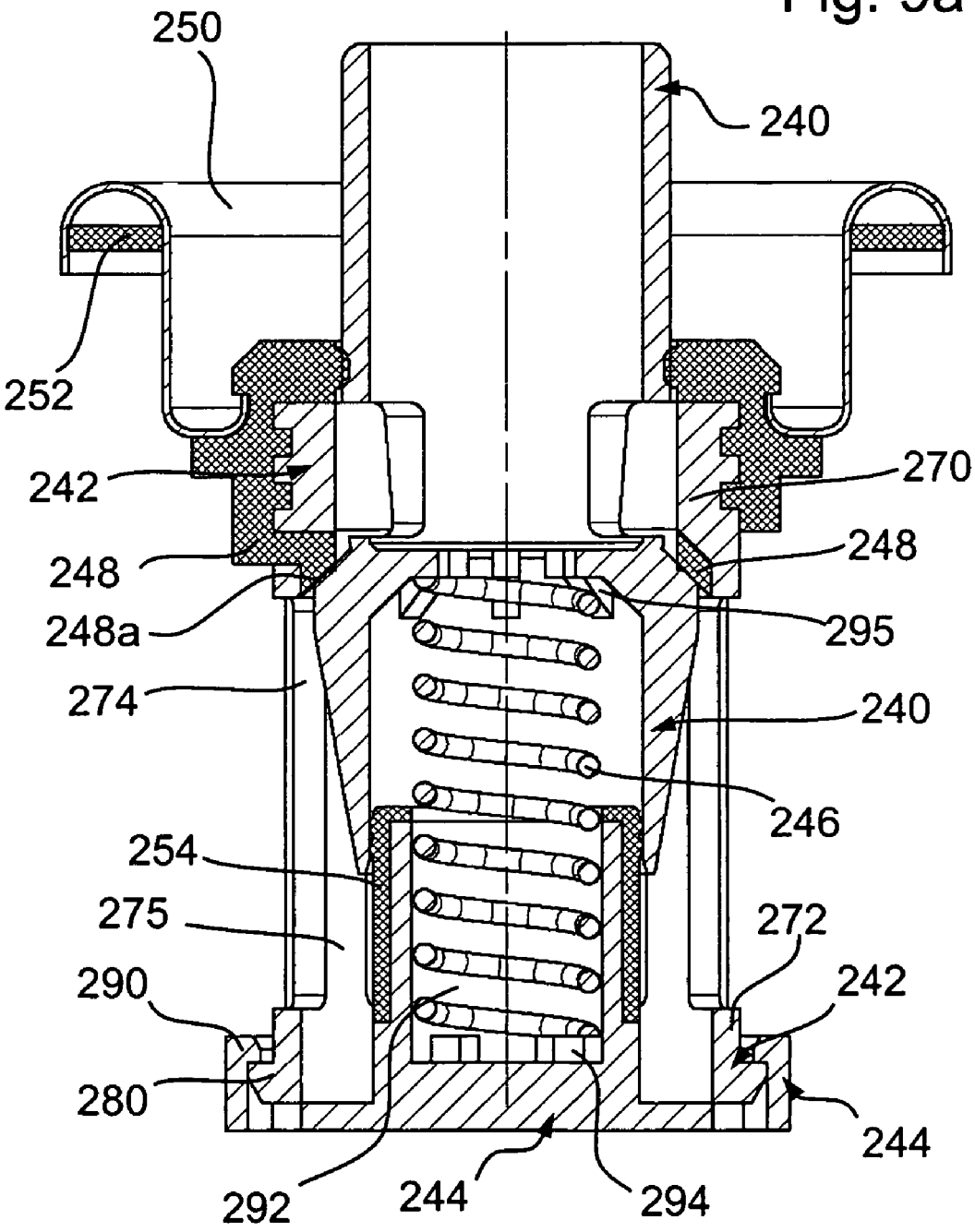
FIG. 9*a* is a sectioned elevation of an alternative valve in accordance with an embodiment of the invention.
Figure 9B:
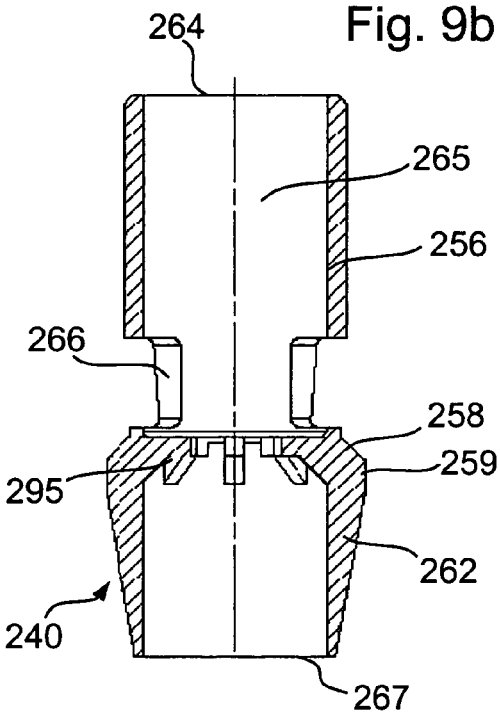
FIG. 9*b* is a section through the stem of the valve of FIG. 9*a;*
Figure 9C:
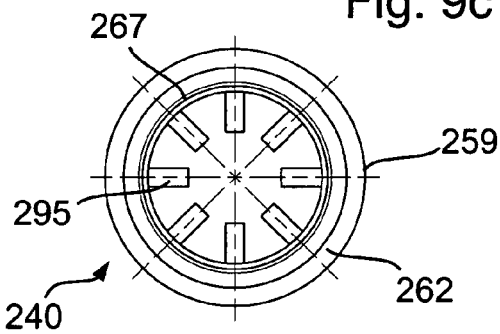
FIG. 9*c* is an orthographic projection on to a plane normal to the direction of the opening force of the valve stem of FIG. 9*b;*
Figure 9D:
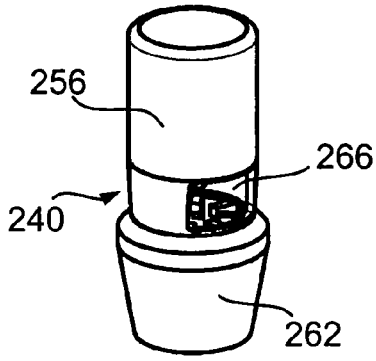
FIG. 9*d* is a perspective view of the valve stem of FIGS. 9*b* and 9*c;*

FIG. 9*c* shows an orthographic projection of the stem (240) onto a plane normal to the direction of the opening force. The area $A_m$ is the area in the orthographic projection of those solid portions of the stem (240), namely the fourth conical section (262) and the base portion (267), on which with the valve in a closed position the pressure of the product to be dispensed acts in a direction opposite to the direction of the opening force. The ratio R for the valve shown in FIG. 9 can therefore be calculated to be around 1.03.

Figure 10:
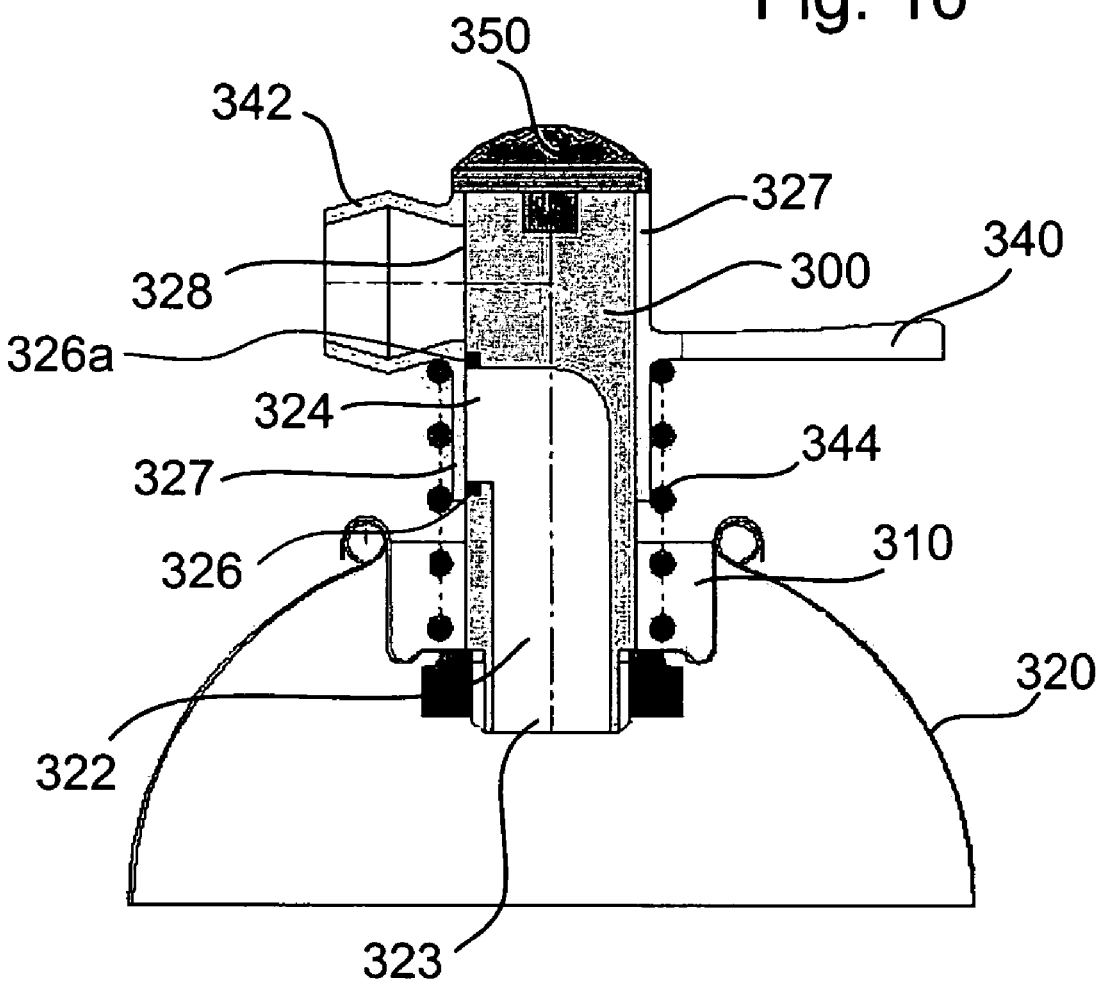
FIG. 10 is a sectioned elevation of a further valve in accordance with an embodiment of the invention.

A further alternative embodiment of a valve according to the invention is shown in FIG. 10. In this embodiment, a cylindrical stem section (300) is sealed into the valve cup (310) of an aerosol can (320), the stem section (300) having a bore (322) extending from a product outlet (324) to an aperture (323) in the base portion of the stem. An actuating lever (340) is attached to a cylindrical sheath section (327) which is slidably and coaxially mounted over the body of the stem (300). A nozzle (342) is in fluid communication with an aperture (328) in the side of the sheath (327). A spring (344) mounted over the sheath section (327) below the lever (340) and the nozzle (342) rests on the upper face of the valve cup (310) and a cap (350) is fitted over the top of the stem (300) which retains the sheath (327) and spring (344).

In use, the sheath (327) is held against the cap (350) by the spring (344) and the sheath (327) covers the aperture (324) in the stem (300) thereby preventing product from flowing through and out of the stem (300). A rubber o-ring (326) forms a seal between the stem (300) and sheath (327), thus providing a valve seat (326*a*). Depression of the lever (340) forces the sheath to slide down the stem (300) against the bias of the spring (344) so that the aperture (328) of the sheath (327) coincides with the outlet (324) in the stem (300) and product is able to flow therethrough. When the lever (340) is released, the spring (344) returns the sheath (327) to its rest position, closing the outlet (324) in the stem (300) and preventing further flow of product.

In the embodiment shown in FIG. 10 the opening force is applied to the sheath (327). As there are no solid parts of the sheath on which the pressure of a product to be dispensed acts in a direction opposite to that of the opening force, then R is zero. Thus the opening force of the valve in FIG. 10 is largely determined by the strength of the spring (344).

In a preferred embodiment of the valve shown in FIGS. 3 to 7, the valve including the housing, stem section, and base section is formed by injection moulding.

Preferred examples of the dimensions for the various sections illustrated in FIGS. 3 to 7 are set out below:

Stem Section

| | |
|---|---|
| Length of stem section (40) | around 31.28 mm |
| Length of first tubular section (56) | around 18.78 mm |
| Length of second conical section (58) | around 1.5 mm |
| Length of third cylindrical section (59) | around 11.0 mm |
| Outer diameter of first tubular section (56) | around 12 mm |
| Inner diameter of first tubular section (56) | around 10 mm |
| Height of apertures (66) | around 5 mm |
| Distance between bottom of apertures (66) and top of second conical section (58) | around 0.5 mm |
| Width of apertures (66) | around 8 mm |
| Outer diameter of third cylindrical section (59) | around 14.5 mm |
| Inner diameter of third cylindrical section (59) | around 10.5 mm |
| Height of groove (62) in third cylindrical section (59) | around 1.2 mm |
| Depth of groove (62) in third cylindrical section (59) | around 0.5 mm |
| Distance between bottom of third cylindrical section (59) and bottom of groove (62) | around 1 mm |

Housing

| | |
|---|---|
| Length of columns (74) | around 7.22 mm |
| Inner diameter of first portion (70) | around 11.5 mm |
| Inner diameter of second portion (72) | around 15 mm |

Base Section

| | |
|---|---|
| Total height of base section (44) | around 13.73 mm |
| Height of second section (84) | around 9.5 mm |
| Diameter of first section (82) | around 14.76 mm |
| Outer diameter of second section (84) | around 23.5 mm |
| Inner diameter of second section (84) | around 21 mm |
| Distance from base of annular cavity (91) to bottom edge of retaining clips (90) | around 2.77 mm |

It is thus considered that the above described valves may be used advantageously to dispense a frozen aerated product, such as a soft-serve ice cream, even in the typical temperature range of a domestic freezer, for example, between −18 to −22° C.

Figure 3B:
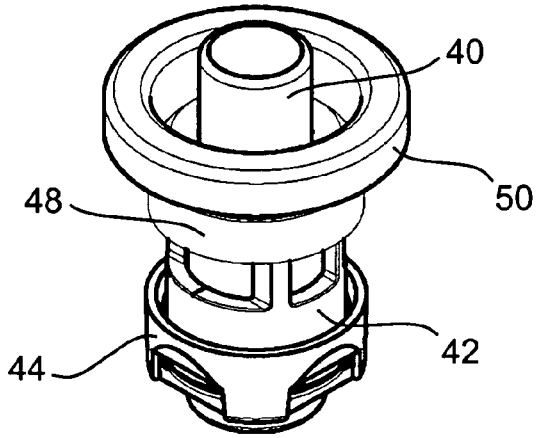
FIG. 3*b* is a perspective view of the valve of FIG. 3*a;*
Figure 4C:
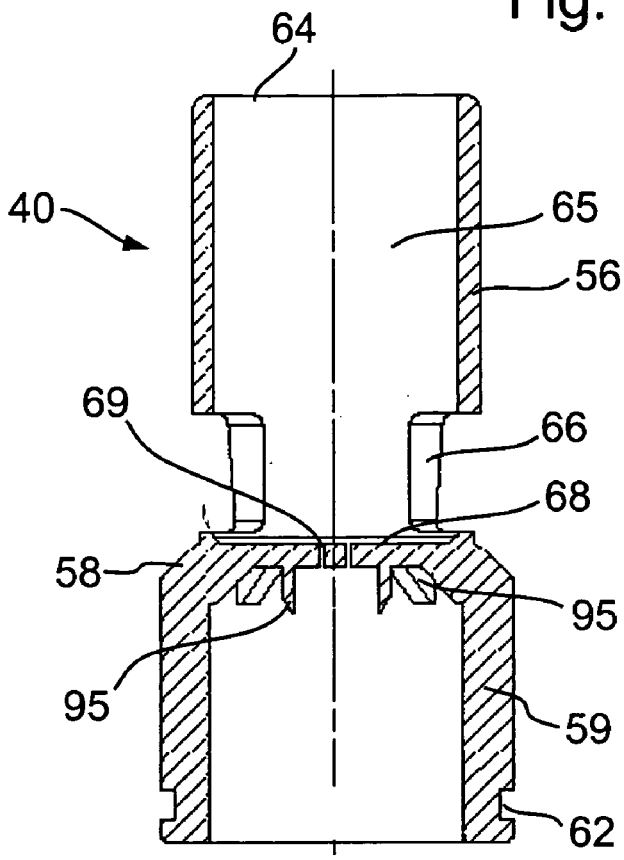
FIG. 4*c* is a section through the valve stem of FIGS. 4*a* and 4*b;*
Figure 4D:
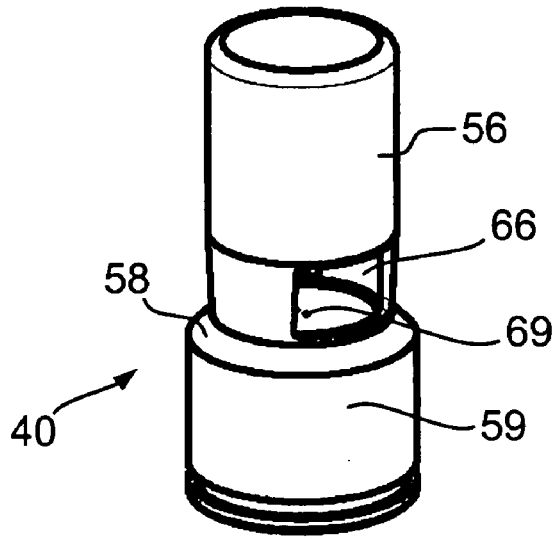
FIG. 4*d* is a perspective view of the stem of FIGS. 4*a*-4*c;*
Figure 5A:
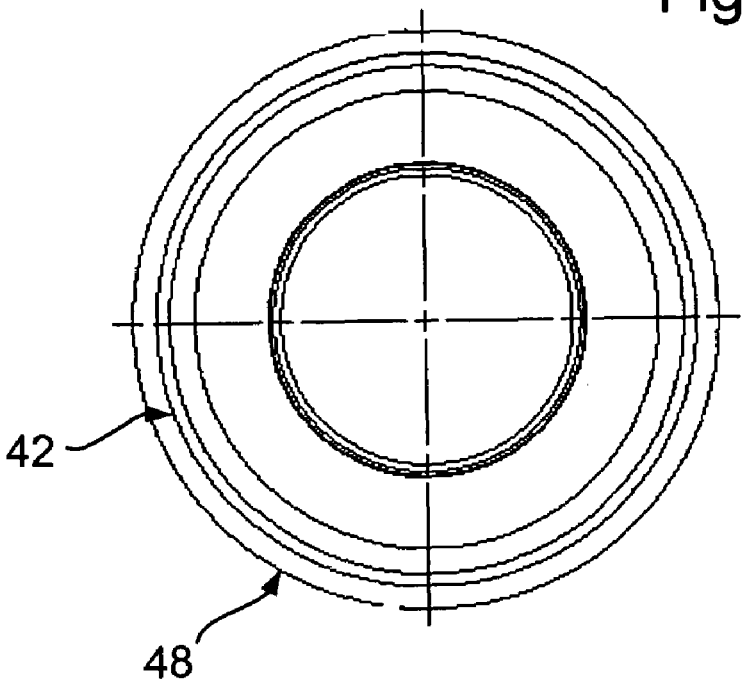
FIG. 5*a* is a plan view of the housing of a valve apparatus in accordance with an embodiment of the invention.
Figure 5B:
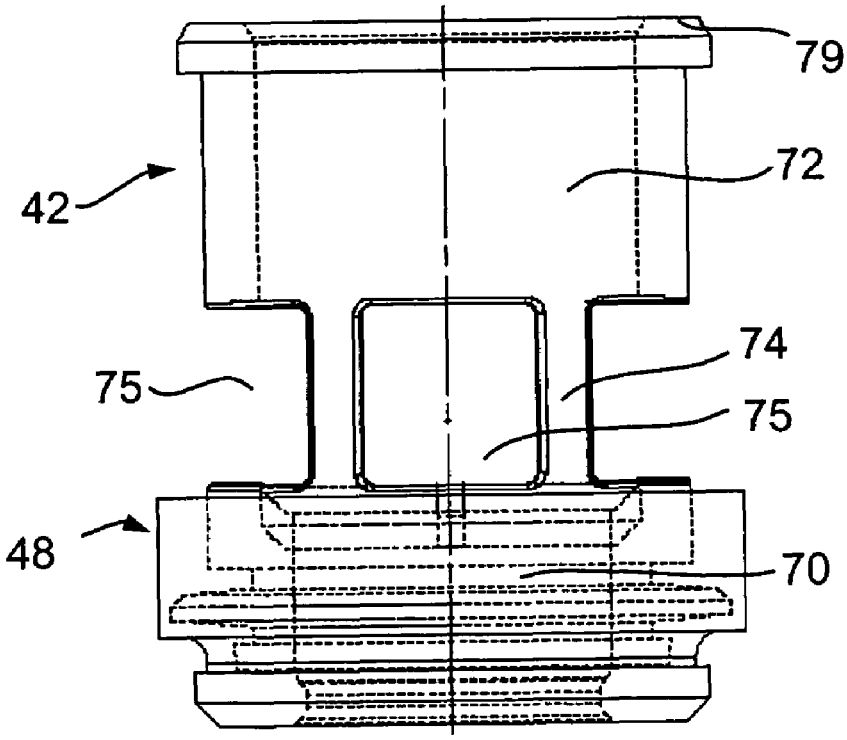
FIG. 5*b* is an elevation of the housing of FIG. 5*a;*
Figure 5C:
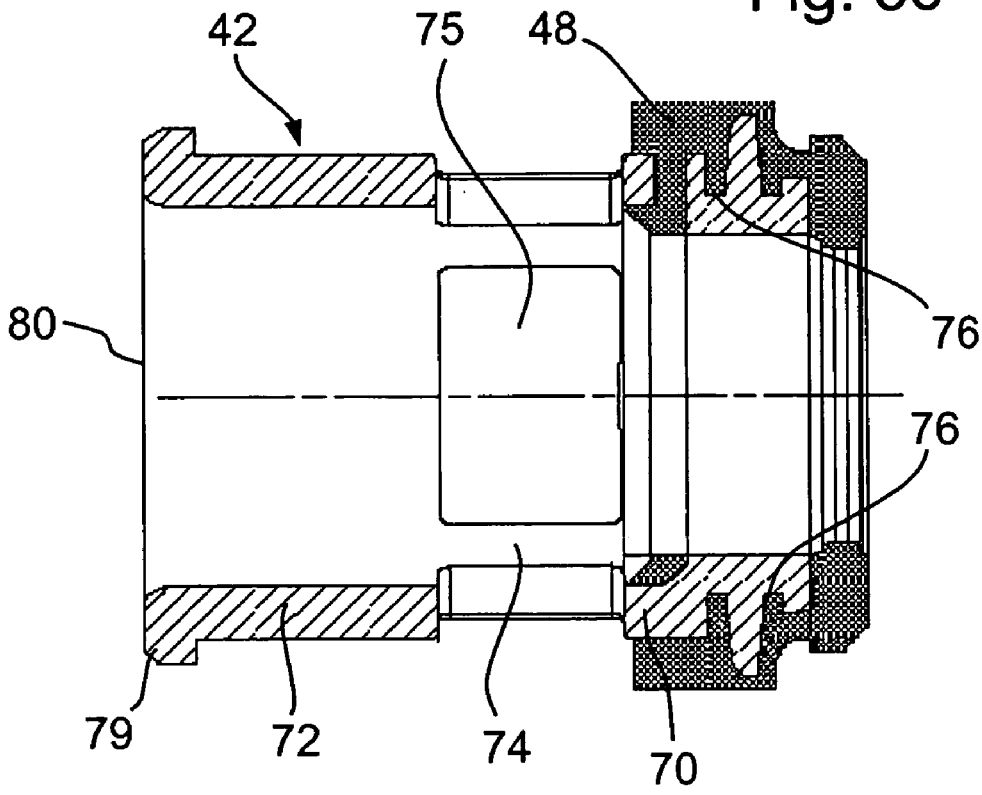
FIG. 5*c* is a sectioned view of the housing of FIGS. 5*a* and 5*b;*
Figure 5D:
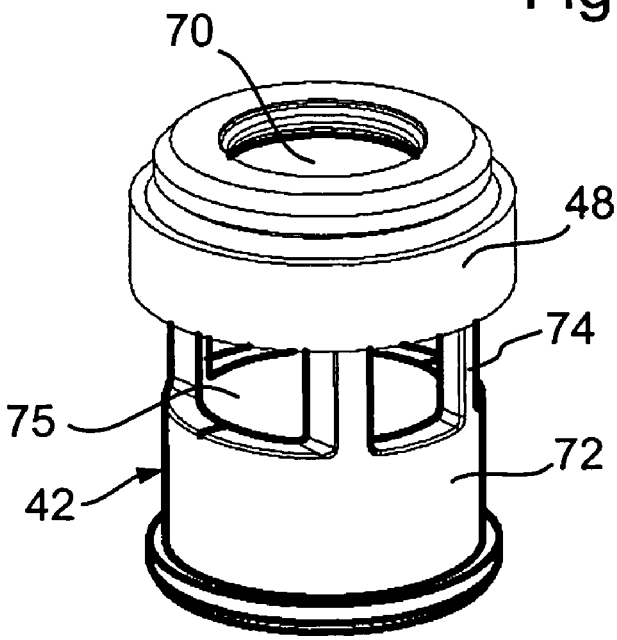
FIG. 5*d* is a perspective view of the housing of FIGS. 5*a*-5*c;*
Figure 6A:
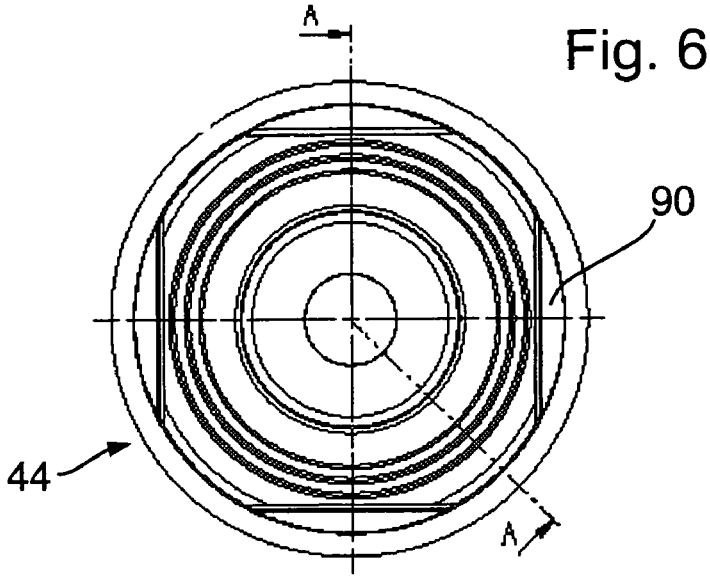
FIG. 6*a* is a plan view of a component of the valve of FIG. 3.
Figure 6B:
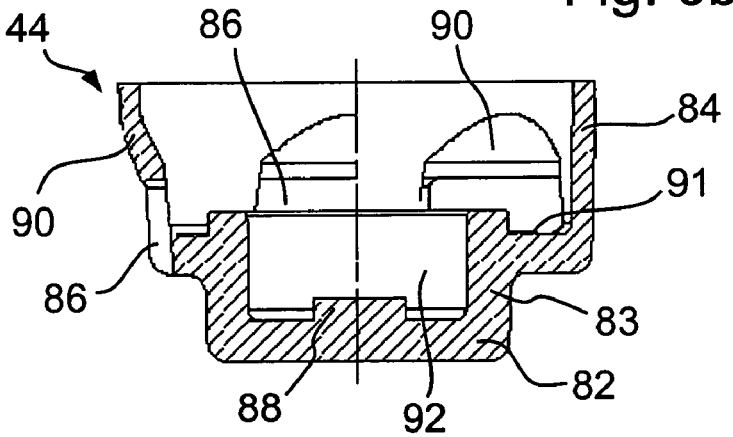
FIG. 6*b* is a sectioned elevation of the component of FIG. 6*a* along the line A-A.
Figure 6C:
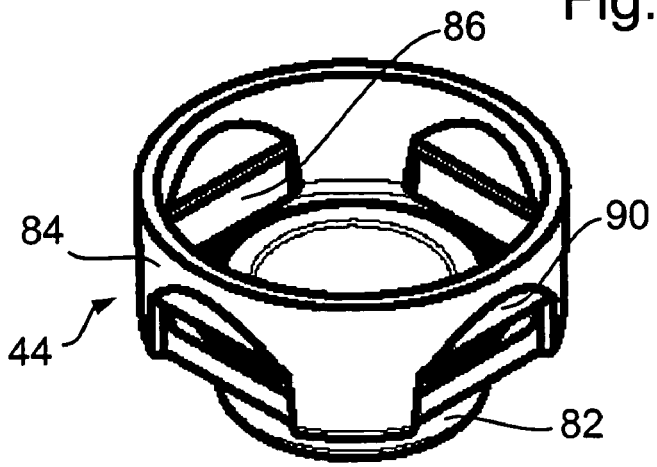
FIG. 6*c* is a perspective view of the component of FIG. 6*a* and 6*b*.

The embodiments of the valve systems shown in FIGS. 3 and 9 are particularly advantageous as the valve is substantially contained within the container in the assembled state. In the valve shown in FIG. 10, the aperture (328) in the sheath (327) is external to the body of the container (320). This is so even when the valve is open such that the aperture (328) in the sheath (327) is in fluid communication with the aperture (323) in the stem (300). Thus the valve seat (326*a*) is external to the body of the container (320) and in the event of damage to the externally protruding parts of the valve shown in FIG. 10, the valve may be incapable of retaining the frozen aerated product within the container.

Variations to the embodiments described above are possible which are within the scope of the invention. For example, the dimensions of the components of the valve assembly given above are preferred dimensions, but any one or more of these dimensions may be varied.

Furthermore, the valve systems illustrated in FIGS. 2 to 10 are particularly advantageous for use in dispensing a frozen aerated product having the following composition:

Freezing point depressants in an amount of between 20% and 40% w/w, preferably above 25%, and between 0% and 15% fat, preferably between 2% and 12%, the freezing point depressants having a number average molecular weight $\langle M\rangle_n$ following the following condition:

$$\langle M\rangle_n = <-8\ \mathrm{FAT}+330$$

wherein FAT is the fat level in percent by weight of the product.

The freezing point depressants may be made at least a level of 98% (w/w) of mono, di and oligosaccharides. In a preferred embodiment, the frozen aerated product contains less than 0.5% (w/w) glycerol, preferably less than 0.25% (w/w), even more preferably less than 0.1% (w/w).

Preferably, the frozen aerated product has an overrun of less than 150%, more preferably less than 140%, and preferably more than 80%. In an alternative preferred embodiment, the frozen aerated product has an overrun of more than 150%, and preferably more than 170%.

The average molecular weight is preferably below 250, more preferably below 230.

In one particularly preferred embodiment, the frozen aerated product is contained in a container of the type shown in FIG. 2, the container having at least two compartments gastightly separated from each other by an at least partially movable wall, one compartment containing a propellant and the other compartment containing the frozen aerated product and having a valve apparatus of the type shown in FIGS. 3 to 7.

The types of container suitable for use in the present invention include those known as piston cans, bag-in-cans and bag-on-valve cans.

EXAMPLE 1

| Formulation | |
|---|---|
| Skimmed Milk Powder | 10.00 |
| Coconut Oil | 10.00 |
| Dextrose | 14.60 |
| Low Fructose Corn syrup | 08.90 |
| Sucrose | 01.20 |
| Monoglyceride Emulsifier | 00.70 |
| Acetic Acid Esters | 00.40 |
| LBG | 00.20 |
| Vanilla Flavour | 00.02 |
| Water | 53.98 |
| (Freezing Point Depressant Solids | 27.7) |
| ($\langle M\rangle_n$ (g mol$^{-1}$) | 225) |

All concentrations are % (w/w).

Specialist materials were as follows:

LBG was Viscogum FA supplied by Degussa Texturant Systems, France.

Monoglyceride emulsifier was ADMUL MG 40-04 supplied by Quest International, Bromborough Port, UK.

Acetic acid ester of monoglyceride was Grinsted ACETEM 50-00 A supplied by Danisco Cultor, Wellingborough, UK.

Low Fructose Corn Syrup was C*TruSweet 017Y4, had a moisture level of 22%, a DE of 63 and was supplied by Cerester, Manchester, UK.

Valve

The valves used in this example were similar to that shown in FIGS. 3 to 7 wherein the inner diameter of the first tubular section (56) of the stem section (40) was 10 mm.

The stem section (40) was injection moulded from POM (polyoxymethylene; Hostaform™ C27021 supplied by Ticona GmbH, Frankfurt, Germany). The housing (42) was injection moulded from PP (polypropylene) containing 20% glass fibre (Piolen® P G20 CA67 supplied by Pio Kunststoffe GmbH, Freiburg, Germany). The end section (44) was injection moulded from POM (Hostaform™ C9021). The first seal (48) was moulded from TPE (thermoplastic elstomer; Santoprene® 271-55EU supplied by Advanced Elastomer Systems, Akron, Ohio) having a glass transition temperature below −60° C. The second and third seals (54), (49) were formed from standard food grade silicone rubber.

The resilient member (46) comprised two helical steel springs acting in parallel as illustrated in FIG. 3*a*. As the springs were mounted coaxially, one within the other, as shown in FIG. 3*a*, it was necessary that one of the springs had a right-hand coil while the other had a left-hand coil to avoid the possibility of the springs becoming entangled in one another. Both springs were made from stainless steel and each had a length of 40 mm in the uncompressed state. The inside spring had a diameter of 5.85 mm and was formed from wire of 0.9 mm thickness. The outer spring had a diameter of 8.45 mm and was formed from wire of 1.3 mm thickness. When the valve was in the closed position the springs were compressed to a length L1 of 24 mm. When the valve was fully open the springs were compressed to a length L2 of 19 mm. The forces exerted by the springs when compressed to L1 were 60 N for the inner spring and 30 N for the outer spring. The forces exerted by the springs when compressed to L2 were 80 N for the inner spring and 40 N for the outer spring. Thus overall the resilient member 46 exerted a force of 90 N on the valve stem (40) in the closed position and a force of 120 N in the open position.

Container

Aluminum aerosol cans of the piston-type (Cebal, Barcelona, Spain) were used (686 ml brim-fill capacity, 18 bar buckle pressure). These cans had a wall-wiping piston (150 ml volume, giving a maximum product volume of 536 ml) and hole to accommodate a bottom-plug. Prior to use, an adhesive insulating label was applied to the body of each can. The labels used were of the expanded-polystyrene type [FoamTac II S2000 (Avery Dennison Group, Pasadena, Calif., USA)] and had a thickness of around 150 μm and a thermal conductivity of around 0.03 W $m^{-1}$ $K^{-1}$ at 273 K.

Process

Mixing

All ingredients except from the fat and emulsifiers were combined in an agitated heated mix tank. The fat was melted and emulsifiers added to the liquid fat prior to pouring into the mix tank. Once all of the ingredients were blended together, the mix was subjected to high shear mixing at a temperature of 65° C. for 2 minutes.

Homogenisation and Pasteurisation

The mix was passed through a homogeniser at 150 bar and 70° C. and then subjected to pasteurisation at 83° C. for 20 s before being rapidly cooled to 4° C. by passing through a plate heat exchanger.

Ageing

The mix was held at 4° C. for 5 hours in an agitated tank prior to freezing.

Gassing

Before attaching the valves, a positive air pressure was applied to the bottom hole of each can to ensure that the piston was pushed to the top. The valves were then clinched onto the cans in the usual manner to give a gas-tight seal. The cans were then bottom gassed to 1.8 barg with compressed air and simultaneously plugged using a Pamasol P593 X two-chamber propellant filler (DH Industries, Laindon, Essex, UK).

Freezing

The formulation was frozen using a typical ice cream freezer (scraped surface heat exchanger, SSHE) operating with an open dasher (series 80), a mix flow rate of 150 l/hour, an extrusion temperature of −9° C. and an overrun (at atmospheric pressure) of 135%.

Filling

From the freezer, the ice cream was fed directly into an aerosol-dosing chamber (DH Industries, Laindon, Essex, UK) at a line pressure of 10.5 barg. When full, the dosing chamber was then pressurised to 60 barg (by means of an intensifier) and a known volume of ice cream injected through the valve into the can. The volume injected was around 512 ml at the line pressure of 10.5 barg, giving a final can pressure of around 10 barg at −10° C. Each valve was then equipped with an actuator as illustrated in FIG. 8, wherein the ratio of the distance from the hinge (103) to the edge of the lever (104) was six times the distance from the hinge (103) to the centre of the stem (40). The cans were then transferred to a −25° C. store for hardening and storage.

Storage

Cans were stored at −25° C. for 1 week and then tempered at either −18° C. or −22° C. for 24 hours before use.

Final Product

The flow rate of the valve was 15.2±0.8 g $s^{-1}$. The opening force of the valve was 155±12 N, which, when equipped with an actuator gives an actuation force of around 25 N. This system was easy to use with a single hand and was found to be ideal for applying the frozen aerated product to desserts and beverages directly on removal from a domestic deep freeze.

EXAMPLE 2

A frozen aerated product in a container was prepared with an identical formulation and in an identical manner to that described in Example 1 with the exception that a different valve was used.

The valves used in this example were similar to that shown in FIG. 9 wherein the inner diameter of the first tubular section (256) of the stem section (240) was 10 mm. The resilient member (246) comprised a single helical steel spring made from stainless steel having a length of 25 mm in the uncompressed state. The spring had a diameter of 7 mm and was formed from wire of 1 mm thickness. When the valve was in the closed position the spring was compressed to a length L1 of 17 mm. When the valve was fully open the spring was compressed to a length L2 of 11 mm. The force exerted by the spring when compressed to L1 was 45 N and when compressed to L2 was 75 N. The flow rate of the valve was 14.7±2.7 g $s^{-1}$. The opening force of the valve was 290±100 N, which, when equipped with an actuator gives an actuation force of around 48 N. The higher opening and actuation forces for the valve in this example compared to that in Example 1 are a consequence of the higher R value, i.e. 1.03 for the valves used in this example compared to zero for the valves used in Example 1. In addition, the fact that the spring (246) was in the open bore (264) of the valves in Example 2 and was thus not isolated from frozen product in the presence of an applied opening force, resulted in frozen product interacting with the spring (246) causing variable performance as demonstrated by the large confidence interval quoted above for the opening force.

The invention claimed is:

1. A frozen aerated product in a container, the frozen aerated product being under a pressure of between 4 and 18 barg, the container being provided with a valve;

characterised in that the valve has a flow rate between 10 and 30 g $s^{-1}$, an opening force between 20 and 200 N and is provided with an actuating member having an actuation force between 20 to 35 N;

wherein the valve comprises:

a valve stem (40, 240, 300) having one or more apertures (66, 266, 323) therein, the valve stem (40, 240, 300) having a product outlet (64, 264, 324), a bore (65, 265, 322) extending from the product outlet (64, 264, 324) to the apertures (66, 266, 323), and a longitudinal axis;

a first member (42, 242, 327) having one or more apertures (75, 275, 328) therein; and a resiliently biasable second member (46, 246, 344);

one or other of the valve stem (40, 240, 300) and the first member (42, 242, 327) being slidably and coaxially mountable on or in the other of the valve stem (40, 240, 300) and the first member (42, 242, 327);

the valve stem (40, 240, 300) and the first member (42, 242, 327) being arranged such that on application of an opening force on the valve stem (40, 240, 300) or the first member (42, 242, 327), the valve stem (40, 240, 300) and the first member (42, 242, 327) slide relative to each other in a direction parallel to the longitudinal axis of the valve stem, and one or more of the apertures (75, 275, 328) in the first member (42, 242, 327) are brought into fluid communication with one or more of the apertures (66, 266, 323) in the valve stem (40, 240, 300);

the second member (46, 246, 344) being arranged to force the apertures (75, 275, 328, 66, 266, 323) in the first member (42, 242, 327) and the valve stem (40, 240, 300) out of said fluid communication when the opening force is released;

characterised in that a ratio R is less than 2.0; and wherein the second member (46, 246, 344) is substantially free from contact with the frozen aerated product in the container.

2. A frozen aerated product in a container according to claim 1 wherein the valve comprises a constriction having a cross-sectional area between 30 and 150 $mm^2$.

3. A frozen aerated product in a container according to claim 1 wherein the container has at least two compartments (A) and (B), the compartments being gastightly separated from each other by an at least partially movable wall, compartment (A) containing a propellant, compartment (B) containing the frozen aerated product and compartment (B) being provided with the valve.

4. A frozen aerated product in a container according to claim 1 wherein the frozen aerated product contains freezing point depressants in an amount between 20% and 40% w/w and a fat level between 0% and 15% fat, the freezing point depressants having a number average molecular weight $\langle M\rangle_n$ following the following condition:

$$\langle M\rangle_n = \langle(330-8*\mathrm{FAT})\,\mathrm{g\ mol}^{-1}$$

wherein FAT is the fat level in percent by weight of the product.

5. A frozen aerated product in a container according to claim 4 wherein the freezing point depressants have a number average molecular weight of less than 250 g $mol^{-1}$.

6. A frozen aerated product in a container according to claim 1 wherein R is less than 0.1.

7. A frozen aerated product in a container according to claim 1 wherein the apertures (75, 275, 66, 266) in both the first member (42, 242) and the valve stem (40, 240) which are brought into said fluid communication upon application of the opening force are located within the body of the container while in said fluid communication.

8. A frozen aerated product in a container according to claim 1 wherein the second member (46, 246) is located entirely within the body of the container.

9. A frozen aerated product in a container according to claim 1 wherein the second member (46, 246, 344) comprises one or more springs.

10. A frozen aerated product in a container according to claim 1 wherein the valve is provided with an actuating member comprising: a first portion (100) and a second portion (102), the second portion (102) being hingedly attached to the first portion (100), the second portion being arranged to apply force to the one or other of the valve stem (40, 240) and the first member (42, 242) on application of a force thereto by a user.

11. A frozen aerated product in a container according to claim 10, wherein the second portion (102) of the actuating member has a first end and a second end (104), the first end being attachable to a hinge (103) on the first portion (100) of the actuating member, and the second end (104) being free, wherein a ratio of the distance from a hinge (103) of the actuating member to the second end (104) of the second portion (102) is approximately three to eight times, the distance from the hinge (103) to a central longitudinal axis of the valve stem (40, 240).

12. A frozen aerated product in a container according to claim 1 wherein the valve stem is isolated from pressure in the container acting in a direction opposite to that of the opening force.

13. A valve suitable for dispensing a frozen aerated product comprising:

a valve stem (40, 300) having one or more apertures (66, 323) therein, the valve stem (40, 300) having a product outlet (64, 324), a bore (65, 322) extending from the product outlet (64, 324) to the apertures (66, 323), and a longitudinal axis;

a first member (42, 327) having one or more apertures (75, 328) therein; and a resiliently biasable second member (46, 344);

one or other of the valve stem (40, 300) and the first member (42, 327) being slidably and coaxially mountable on or in the other of the valve stem (40, 300) and the first member (42, 327);

the valve stem (40, 300) and the first member (42, 327) being arranged such that on application of an opening force on the valve stem (40, 300) or the first member (42, 327) the valve stem (40, 300) and the first member (42, 327) slide relative to each other in a direction parallel to the longitudinal axis of the valve stem, and one or more of the apertures (75, 328) in the first member (42, 327) are brought into fluid communication with one or more of the apertures (66, 323) in the valve stem (40, 300);

the second member (46, 344) being arranged to force the apertures (75, 328, 66, 323) in the first member (42, 327) and the valve stem (40, 300) out of said fluid communication when the opening force is released;

characterised in that a ratio R is less than 0.1; and wherein the second member (46, 246, 344) is substantially free from contact with the frozen aerated product in the container.

14. A valve according to claim 13 wherein the ratio R is less than 0.01.

15. A valve according to claim 13 wherein the valve is arranged to dispense a product from a pressurised container and the apertures (75, 66) in both the first member (42) and the valve stem (40) which are brought into said fluid communication upon application of the opening force are located within the body of the container while in said fluid communication.

16. A valve according to claim 13 wherein the second member comprises one or more springs.

17. A valve for dispensing a product from a pressurised container, the valve comprising:

a first piece (42) which is fixedly attachable to the container;

a second piece (40) which is coaxially translatable on or in the first piece (42);

a valve seat (48*a*) disposed between the first (42) and second (40) pieces and defining a closure, the valve seat (48*a*) being within the body of the container; and a bore (65) extending from the seat (48*a*) to a product outlet (64);

a resiliently biasable member (46) arranged to apply a closing force to the second piece (40)

the valve being openable by coaxial translation of the second piece (40) on or in the first piece (42) in an opening direction;

characterised in that a total surface area (Am) of the second piece (40) on which an internal pressure of the container acts in a direction opposite to the opening direction is less than 30% of a cross-sectional area of the bore (Ab); and wherein the resiliently biasable member (46) is substantially free from contact with a frozen aerated product in the container.

18. A valve according to claim 17 wherein the total surface area ($A_m$) of the second piece (40) on which the internal pressure of the container acts in a direction opposite to the opening direction is less than 10% of the cross-sectional area of the bore ($A_b$).

19. A valve according to claim 17 wherein the total surface area ($A_m$) of the second piece (40) on which the internal pressure of the container acts in a direction opposite to the opening direction is less than 5% of the cross-sectional area of the bore ($A_b$).

20. A valve according to claim 17 wherein the total surface area ($A_m$) of the second piece (40) on which the internal pressure of the container acts in a direction opposite to the opening direction is less than 1% of the cross-sectional area of the bore ($A_b$).

21. A valve according to claim 17 wherein the resiliently biasable member (46) is one or more springs.

22. A valve according to claim 17 wherein the resiliently biasable member is within the body of the container.

* * * * *